United States Patent [19]

Nakamura et al.

[11] Patent Number: 4,488,085

[45] Date of Patent: Dec. 11, 1984

[54] IMAGE PICK-UP TUBE ARRANGEMENT

[75] Inventors: Takashi Nakamura; Yoshihiro Morioka; Hiroyuki Sugimoto, all of Atsugi, Japan

[73] Assignee: Sony Corporation, Tokyo, Japan

[21] Appl. No.: 360,436

[22] Filed: Mar. 22, 1982

[30] Foreign Application Priority Data

Mar. 31, 1981 [JP] Japan ..... 56-45506[U]

[51] Int. Cl.[3] ..... H01J 23/16; H01J 29/96

[52] U.S. Cl. ..... 315/3; 313/365; 313/366

[58] Field of Search ..... 315/3; 313/331, 365, 313/366, 371, 372, 370; 358/43

[56] References Cited

U.S. PATENT DOCUMENTS 3,612,943 10/1971 Ramstadt et al. ..... 315/3
3,699,375 10/1972 Weibel ..... 313/366
3,857,037 12/1974 Tomii et al. ..... 313/331
4,039,888 8/1977 Ashikawa et al. ..... 313/331
4,166,969 9/1979 Hoeberchts ..... 313/371
4,196,369 4/1980 Geus et al. ..... 313/365
4,196,372 4/1980 Month et al. ..... 313/371

*Primary Examiner*—Saxfield Chatmon
*Attorney, Agent, or Firm*—Hill, Van Santen, Steadman & Simpson

[57] ABSTRACT

An image pick-up tube which has a high signal to noise ratio relative to the prior art provides for a disk-shaped printed circuit board formed with a central opening through which the image can pass to strike the active part of the tube and wherein the printed circuit board carries a first amplifier stage which is very closely spaced and connected to the image pick-up means so as to provide minimum lead lengths to reduce stray capacitance and give high signal to noise ratio.

5 Claims, 7 Drawing Figures

IMAGE PICK-UP TUBE ARRANGEMENT

BACKGROUND OF THE INVENTION

1. Field of the Invention

This invention relates in general to an image pick-up tube having a photoconductive image pick-up tube and more particularly it provides an image pick-up apparatus in which the signal to noise ratio is substantially improved over prior art devices and wherein a first stage circuit of a pre-amplifier is mounted on the face plate of the image pick-up tube so as to reduce the lead lengths relative to prior art devices.

2. Description of the Prior Art

The signal current that is obtained from a photoconductive image pick-up tube such as a Plumbicon (TM) or a Saticon (TM) is generally very small and is of the order of 0.3 $\mu$A even for the white portion of the projected image. Thus, with the image pick-up tubes using photoconductive image pick-ups, it is necessary to amplify the image output signal from the image pick-up tube before subjecting the image output signal to various signal processing. Also, it has been well known, that with the pre-amplifier for amplifying the image output signal from the image pick-up tube that the first stage circuit is the substantial influence on the signal to noise ratio of the entire system. In order to improve the signal to noise ratio, it is necessary to increase the input resistance and also reduce the stray capacitance due to the electrodes and the wiring lead length of the image pick-up tube.

FIG. 1 illustrates the general construction of a pre-amplifier. An image pick-up tube 1 is provided with a signal electrode ring which is connected to a first stage 3 which is a feedback type circuit and uses an amplifier element which is a junction type field effect transistor 4 that has a high neutral conductance. The output of a subsequent amplifier stage 9 receives the output of the field effect transistor 4 and is fed back through a feedback resistor 5 to the gate of the field effect transistor 4. As illustrated in FIG. 1, a resistor 6 is provided to apply a target voltage $V_{TT}$ through the signal electrode ring to the image pick-up tube 1. A capacitor 7 is connected in series for blocking DC current. The resistor 6 and capacitor 7 may be omitted where the target voltage $V_{TT}$ is maintained at ground potential with the application of a negative voltage to the cathode side of the image pick-up tube 1.

In the pre-amplifier as described above, the reduction of the SN ratio due to the input resistance will not occur if the feedback resistor 5 has a value of more than 1 M$\Omega$. Previously, however, the pre-amplifier was formed on a printed circuit board and was separately mounted from the image pick-up tube and was connected to the image pick-up tube by leads. The stray capacitance $C_0$ in the first stage circuit 3 is increased by the lead lengths particularly the grounding leads and, thus, the signal to noise ratio is reduced due to the stray capacitance $C_0$ which results in an inferior device in operation.

SUMMARY OF THE INVENTION

The present invention substantially reduces the lead length and the stray capacitance in an image pick-up tube by utilizing the unused areas of the face plate of the image pick-up tube so as to form and mount a printed circuit which is formed with an aligned opening through which the image can pass to the target and wherein the output of the tube is connected to a pre-amplifier on the printed circuit and wherein the through leads and conductor leads can be very short due to the close proximity of the amplifier with the target thus increasing the signal to noise ratio and also reducing stray capacitance.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

The present invention comprises an image pick-up apparatus in which the stray capacitance due to the length of the wiring connectors in the first stage circuit of the pre-amplifier is substantially reduced by mounting the pre-amplifier on a printed circuit in the unused area of the face plate of the image pick-up tube.

Figure 1:
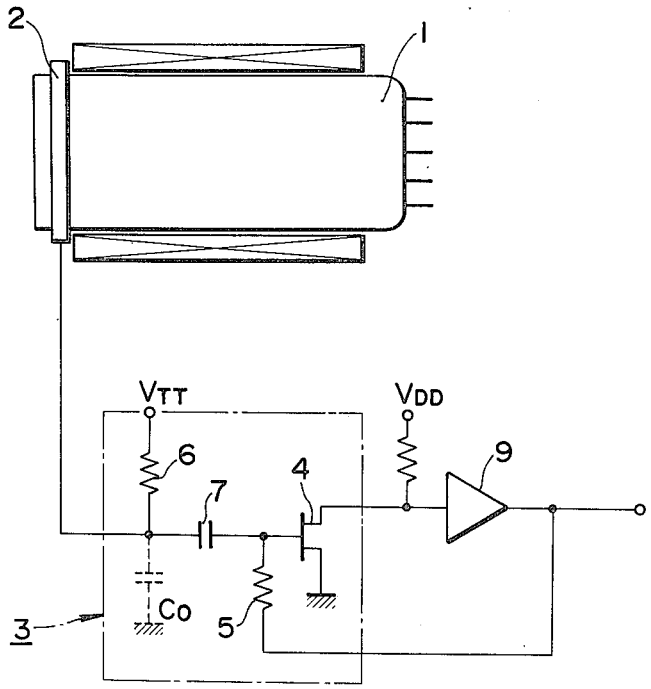
FIG. 1 is a circuit diagram illustrating the general construction of a pre-amplifier in an image pick-up tube having a photoconductive image pick-up tube according to the invention.
Figure 2:
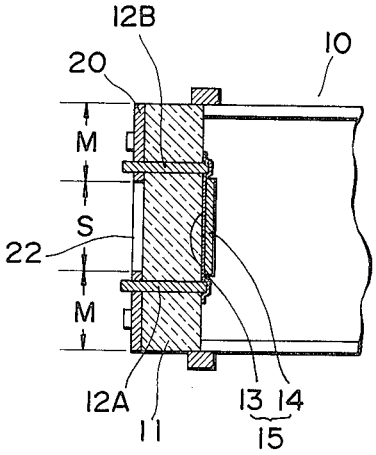
FIG. 2 is a detail sectional view illustrating a first embodiment of the invention.
Figure 3:
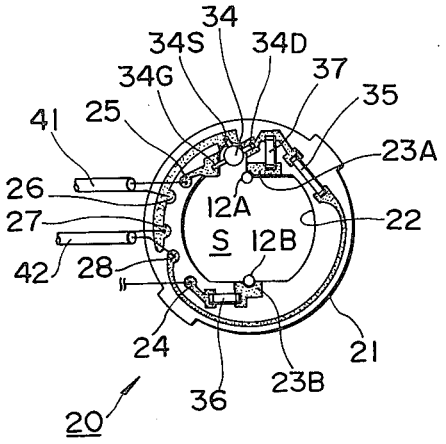
FIG. 3 is a plan view of the invention with the circuit components mounted thereon.
Figure 4:
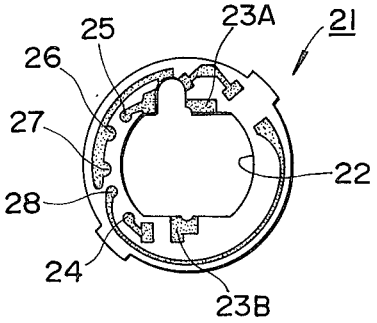
FIG. 4 is a plan view of the printed circuit board of the invention.

FIG. 1 illustrates a general arrangement of the pre-amplifier in an image pick-up tube and in the present invention as illustrated in FIGS. 2 through 4 which illustrates a first embodiment of the invention. A photoconductive image pick-up tube has a face plate 11 with a target 15 mounted on the back side of the face plate on the inside of the tube and a pair of two symmetrical electrode pins 11A and 11B extend through the face plate 11 in unused portions of the face plate where they will not interfere with the target image. The target 15 consists of a lamination of a transparent electrode 13 and a photoconductive film 14. The target is connected to the outside circuit by the two electrode pins 12A and 12B. On the front side of the face plate 11 of the image pick-up tube a printed circuit board 20 is connected as by bonding and has an opening 22 in the center thereof which corresponds to the effective area of the target 15. Thus, an image can be detected by the target 15 by passing through the opening 22 in the printed circuit board 20 to produce electrical output image signals from the target.

The circuit substrate 20 is formed with various circuit components utilizing a printed circuit wiring diagram and in general comprises a disk-shaped substrate 21 of ceramic material or the like upon which a printed circuit wiring diagram for the various circuit components is formed. The transparent electrode 13 is not electrically connected to the electrode ring 16 in the invention as it is in prior art conventional image pick-up tubes.

In the invention the two electrode pins 12A and 12B are electrically connected respectively to the printed circuit connector patterns 23A and 23B on the substrate 21 as illustrated in FIG. 3. The electrode pin 12A is connected through a capacitor 37 to the gate terminal 34G of a field effect transistor 34 and also to one end of a feedback resistor 35. The other electrode pin 12B is connected through a load resistor 36 to terminal 24 for applying the target voltage application. The wiring pattern to which the drain terminal 34D of the field effect transistor 34 is connected is provided with an external connector 25 for removing the output signal and the drain terminal 34D is connected to the center connector of a shielded line 41 for connecting external connector 25 to the input terminal of the second stage amplifier circuit of the pre-amplifier.

The wiring pattern to which the source terminal 34S of the transistor 34 is connected forms a grounding line and is provided with two external grounding connectors 26 and 27. The wiring pattern to which the other end of the feedback resistor 35 is connected is provided with an external connector 28 for coupling the feedback input.

A feedback signal from the second stage amplifying circuit not shown is supplied through the center conductor of a shielded line 42 which is connected to the connector 28.

In the embodiment illustrated, the first stage circuit of the pre-amplifier is formed with the field effect transistor 34 on the circuit board 20 which is arranged on the unused area of the image pick-up tube 10 and an image output signal from the image pick-up tube 10 to which a target voltage $V_{TT}$ is applied through the electrode terminal 12B is fed through the other electrode terminal 12A to the gate terminal 34G of the field effect transistor 34. Thus, in the embodiment illustrated in FIGS. 2 through 4, the lead lengths to the first amplifier stage are very short due to the close proximity of the mounting of the printed circuit board 20 to the target 15 and also the signal to noise ratio is substantially improved over prior art devices.

Figure 5:
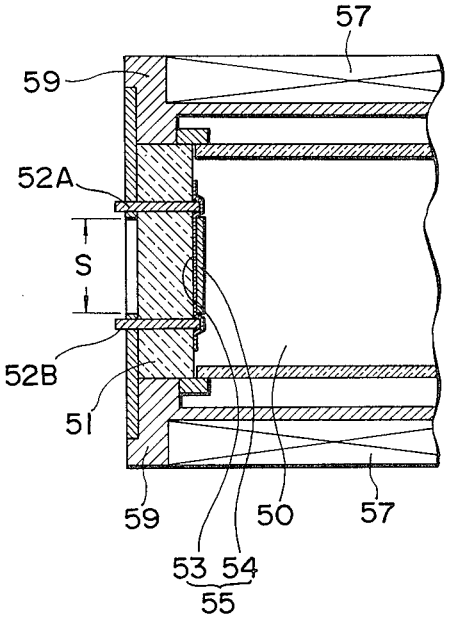
FIG. 5 is a sectional view of another embodiment of the invention.
Figure 6:
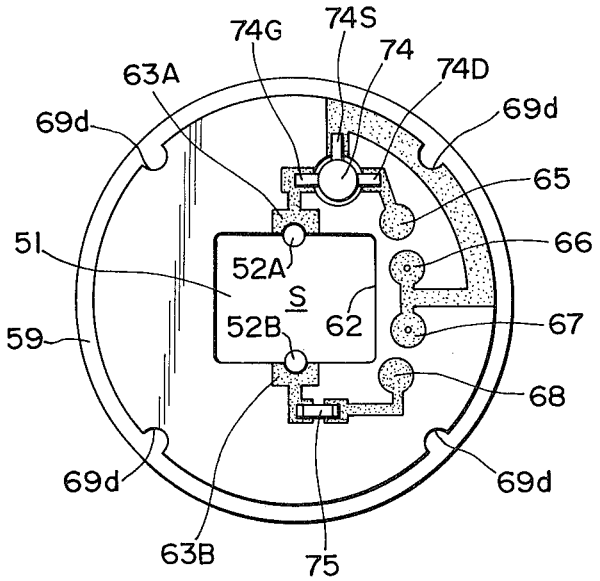
FIG. 6 is a plan view of the printed circuit of the invention with the electrical components mounted thereon.
Figure 7:
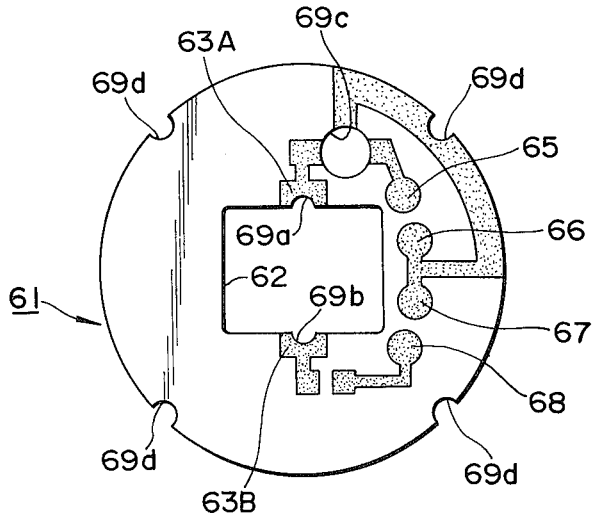
FIG. 7 is a plan view of the printed circuit of the second embodiment of the invention.

A second embodiment is illustrated in FIGS. 5, 6 and 7 wherein a printed circuit board 60 having a diameter conforming to the outer diameter of a beam scan or beam focus coil assembly 57 of an image pick-up tube 50 is mounted on the face plate 51. In this embodiment, the photoconductive image pick-up tube 50 has two electrode pins 52A and 52B which extend through the face plate 51 at symmetrical locations of the unused screen area. The face plate 51 is provided on the backside with a target 55 which consists of a lamination of a transparent electrode 53 and a photoconductive film 54. The target is electrically connected to the external circuitry through the two electrode pins 52A and 52B. On the front side of the face plate of the image pick-up tube 50 is connected a circuit board 60 which has an opening 62 corresponding to the effective screen area S of the image pick-up tube 50. The board 60 is bonded to the front of the face plate 51. On the circuit board 60 is mounted a field effect transistor 74 and a feedback resistor 75 which comprise the first stage circuit of a pre-amplifier circuit and these are formed on a substrate 61 of a ceramic material or the like on which a printed circuit wiring pattern is formed.

The two electrode pins 52A and 52B are electrically connected to respective conductive patterns 63A and 63B formed on the substrate 61. Electrode pin 52A is connected by the connector pattern 63A to the gate terminal 74G of the field effect transistor 74. The other electrode pin 52B is connected through the connector pattern 63B to one end of a feedback resistor 75. The wiring pattern to which the other end of the feedback resistor 75 is formed with an external connector 68 for providing the feedback input. The wiring pattern to which the drain terminal 74D of the field effect transistor 74 is connected is formed with an external connector 65 for supplying the output signal. The wiring pattern to which the source terminal 74S of the transistor 74 is connected forms a grounding line which is connected to two grounding external connectors 66 and 67. The drain terminal 74D of the transistor 74 is connected through a shielded line not shown for supplying the output signal which is connected to the external connector 65 for supplying the output signal and to the external connector 66 for grounding and to the input terminal of the second amplifier stage circuit which is provided as a separate unit. The other end of the feedback resistor 75 is connected through a shielded line not shown which is connected to the external connector 68 for feedback and external connector 67 for grounding and to the output terminal of the second stage amplifying circuit.

In this embodiment, a negative voltage is applied to the cathode electrode of the image pick-up tube 50 and the target 55 is held at ground potential. The circuit board 60 is provided at positions corresponding to the electrode pins 52A and 52B with notches **69*a* and 69*b* and is formed at a position which corresponds to the position of the transistor 74 with a small opening 69*c*. Along the periphery of the circuit board 60 at symmetrical locations are formed positioning notches 69*d* for positioning the frame 59 in which the coil assembly 57 of the image pick-up tube 50** is mounted.

In the embodiments described above in which the circuit boards 20 or 60 are mounted on the face plate 11 or 51 of the image pick-up tubes 10 or 50 which are formed with openings 22 or 62 corresponding to the effective screen area, it is possible to integrate the first circuit section of the pre-amplifier and the image pick-up tube 10 or 50 for reducing the size of the apparatus by effectively utilizing the unused screen area of the image pick-up tubes 10 or 50. Also, since the circuit boards 20 or 60 are mounted on the face plate 11 or 51, the lead lengths of the wiring required for the electrical connection of the image pick-up tubes 10 or 50 to the target 15 or 55 are greatly reduced which reduces the stray capacitance and improves the signal to noise ratio. Also, since the two electrode pins 12A and 12B or 52A and 52B are provided such that they extend through the face plates 11 or 51 in the unused screen area of the image pick-up tubes 10 or 50 at symmetrical positions it is possible to mount the circuit parts in a distributed fashion on the circuit boards 20 or 60 and thus reduce the lengths of the printed circuit wiring.

The above embodiments of the invention are concerned with a single tube type image pick-up tube having a single photoconductive image pick-up but the invention may also be applied not only to such types but also to multiple tube type image pick-up tubes having a plurality of photoconductive image pick-ups. In the case of multiple image pick-up tubes, it is necessary to improve the signal to noise ratio of the image output signal obtained from each image pick-up tube without variations and fluctuations and, thus, the construction which is capable of reducing the stray capacitance due to wiring length according to the present invention is very effective.

As described, the image pick-up tube which have two electrode pins provided such that they penetrate the face plate in the unused screen area of the photoconductive image pick-up tube at symmetrical positions and connect a circuit board having component parts of the first amplifying stage circuit of the pre-amplifier mounted on the base plate of the face plate which has an opening corresponding to the effective screen area of the image pick-up tube. The target of the image pick-up tube is electrically connected to the first amplifying stage circuit through the two electrode pins and it is possible to integrate the face plate of the first amplifier circuit of the pre-amplifier and image pick-up tube by effectively utilizing the unused screen area of the photoconductive image pick-up tube. Also, the circuit board is mounted on the face plate of the image pick-up tube and the wiring lengths of the connectors connecting the target of the image pick-up tube to the first amplifier stage of the pre-amplifier can be extremely short which will improve the signal to noise ratio. Also, the two electrode pins which are symmetrically provided in the face plate allow the component parts of the circuit board to be mounted in a distributed fashion and thus reduce the wiring pattern which also improves the signal to noise ratio.

Although the invention has been described with respect to preferred embodiments, it is not to be so limited as changes and modifications can be made which are within the full intended scope of the invention as defined by the appended claims.

We claim as our invention:

1. A photoconductive type image pick-up tube comprising; a signal deriving target electrode through a face plate glass of the image pick-up tube and connected to a transparent electrode mounted in the inside of the pick-up tube, an electron gun mounted in said pick-up tube for scanning said target electrode, a printed circuit board having an aperture corresponding to the effective area of said image pick-up tube and mounted on said face plate glass on the outside of said pick-up tube, components of a first stage amplifier mounted on said printed circuit board, said components including at least an active transister device, a load resistor and a feedback resistor and said amplifier connected to said signal deriving target electrode.

2. An image pick-up apparatus as cited in claim 1, wherein said circuit board is a circular disk, and said aperture is positioned approximately at the center of said circular disk.

3. An image pick-up apparatus as cited in claim 2, wherein a pair of said signal deriving electrodes are mounted symmetrically on said face plate glass at the outer edges of said effective area of said image pick-up tube.

4. An image pick-up apparatus as cited in claim 3, wherein a portion of the circuit patterns printed on said circuit board extend to said signal deriving electrodes so that they can be soldered thereto.

5. An image pick-up apparatus as cited in claim 4, wherein one of said electrodes is connected to said load resistor, and the other of said electrodes is connected to a coupling capacitor.

* * * * *